US006868846B2

(12) United States Patent
Jzn

(10) Patent No.: US 6,868,846 B2
(45) Date of Patent: Mar. 22, 2005

(54) STRUCTURE FOR A TOY GUN

(76) Inventor: Amy Jzn, 3F, No. 8, Lane 337, Yung Ho Rd., Chung Ho City, Taipei Hsien (TW)

( * ) Notice: Subject to any disclaimer, the term of this patent is extended or adjusted under 35 U.S.C. 154(b) by 0 days.

(21) Appl. No.: 10/436,305

(22) Filed: May 12, 2003

(65) Prior Publication Data

US 2004/0226549 A1 Nov. 18, 2004

(51) Int. Cl.[7] ..... F41B 11/00
(52) U.S. Cl. ..... 124/74
(58) Field of Search ..... 124/71–77

(56) References Cited

U.S. PATENT DOCUMENTS

| | | | | | |
|---|---|---|---|---|---|
| 5,063,905 | A | * | 11/1991 | Farrell | 124/72 |
| 5,333,594 | A | * | 8/1994 | Robinson | 124/73 |
| 6,142,136 | A | * | 11/2000 | Velasco | 124/71 |
| 6,360,736 | B1 | * | 3/2002 | Juan | 124/77 |
| 6,371,099 | B1 | * | 4/2002 | Lee | 124/66 |
| 6,553,983 | B1 | * | 4/2003 | Li | 124/73 |
| 6,694,963 | B1 | * | 2/2004 | Taylor | 124/32 |
| 2003/0024519 | A1 | * | 2/2003 | Chen | 124/72 |
| 2003/0079731 | A1 | * | 5/2003 | Dobbins | 124/76 |
| 2003/0168053 | A1 | * | 9/2003 | Farrell | 124/76 |
| 2003/0178018 | A1 | * | 9/2003 | Cherry | 124/76 |
| 2003/0230296 | A1 | * | 12/2003 | Farrell | 124/73 |
| 2004/0000301 | A1 | * | 1/2004 | Dziob | 124/71 |

* cited by examiner

*Primary Examiner*—Michael J. Carone
*Assistant Examiner*—Troy Chambers
(74) *Attorney, Agent, or Firm*—Rosenberg, Klein & Lee

(57) ABSTRACT

The present invention discloses an improved structure for a toy gun comprises a body, which includes an upper moving trough and a lower moving trough, both are parallel to each other and connected via a connecting trough; inside the upper moving trough is an extruder and inside the lower moving trough is arranged a rear portion, a mechanical component connecting to the rear portion and a valve controller connecting to the mechanical component in series from a rear end of the lower moving trough. Wherein, for the design of the extruder, the connecting piece is driven by the pulling portion, thus to rotate the pulling portion is to generate relative and radial motions among the connecting piece in the connecting trough, the injection portion and the mechanical component; further that, the connecting piece is taken off from the mechanical component to terminate the connecting stage of the extruder and the mechanical component. To turn the knob of the rear portion is to simultaneously move the leading rod of the rear portion in the rear piece back and forth, and the knob may not have an axial movement from original position thereof. Further, to utilize the rotation of the rotating piece of the gas-control portion is capable of controlling the adjusting rod; hence the thimble of the gas-control portion being driven is to handle the combining body.

5 Claims, 9 Drawing Sheets

STRUCTURE FOR A TOY GUN

BACKGROUND OF THE INVENTION

1. Field of the Invention

The present invention generally relates to an improved structure for a toy gun, especially to the structure being dismantled very easily and enhanced safety.

2. Description of the Prior Art

During 1970s, there were several types of toy guns, and most of them adopted springs to push toy bullets out. After several decades of years, human being life is built up to another stage so as to asking product qualities; besides, toy makers have being started to develop new toy guns with good appearances and more truth. Hence, a Flexible Fire-pin Gun with a flat head was generated but with many different types, it had being popular for a while and was with poor precision and a short range of fire. In the middle of 1990s, another Air-soft Gun via air-compression theory was derived. Unfortunately, operations for the Air-soft Gun are very similar to rifle operations, that is, once to pull a trigger is only able to shoot one bullet; therefore a new toy gun with continuous shooting was developed and produced, and it was called Gas Gun by way of compressing CO2 to generate power. For the Gas Gun, it was much more like a real gun based on quality and structure requests.

Even if Gas Gun was developed to be as reality, its shortcoming was still exist. As an example, some left gas in a gas tank suddenly blowing off causes accidents while the gas tank being dismantled. In addition, to design a mechanical component and an extruder being workable simultaneously is by means of a connector, but the connector should be taken out firstly and then the extruder and the mechanical component just can be dismantled while a bullet stuck in a barrel. That is, processes to dismantle for cleaning are complicate and spending time. In case of playing games, the processes being as simple as possible are the most request.

SUMMARY OF THE INVENTION

The main objective of the present invention is to offer an improved structure for a toy gun for solving aforesaid shortcomings. The present invention adopts rotating a knob to control movement of an adjusting rod, and also a leading rod in a rear portion; additionally, the knob may not leave its own original position although it is rotated. While rotating a pulling portion to let an injecting portion have a relative movement in radial direction with a mechanical component via a connector and the connector depart from the mechanical component, then a connecting status for the injecting portion and the mechanical component is finished. To rotate the knob for controlling movement of the adjusting rod is to drive an extruder to further control a position in a body of the toy gun thereof.

Other and further features, advantages and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE INVENTION

Figure 1:
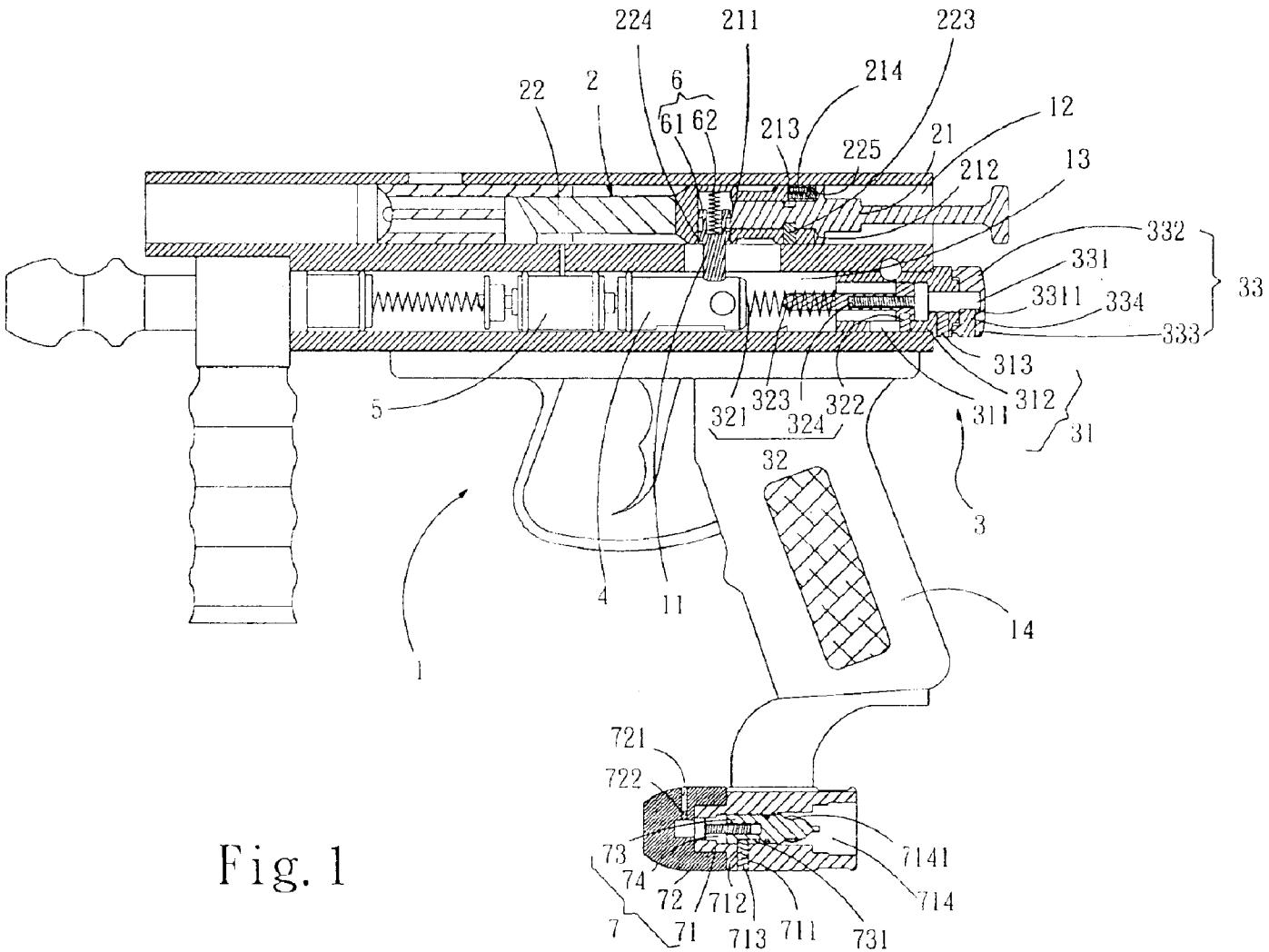
FIG. 1 is a sectional view of an assembly of the present invention.

Please refer to FIG. 1, which is a sectional view of an assembly of the present invention. The present invention comprises a body 1, which includes an upper moving trough 12 and a lower moving trough 13, both are parallel to each other and connected via a connecting trough 11; inside the upper moving trough 12 is an extruder 2 and inside the lower moving trough 13 is arranged a rear portion 3, a mechanical component 4 connecting to the rear portion 3 and a valve controller 5 connecting to the mechanical component 4 in series from a rear end of the lower moving trough 13; wherein the mechanical component 4 connects to the extruder 2 via a connecting piece 6 penetrating through the connecting trough 11; the extruder 2 consists of a pulling portion 21 and an injecting portion 22, an end of the injecting portion 22 is out of the upper moving trough 12, and the connecting piece 6 is on the injecting portion 22; the rear portion 3 further includes a rear piece 31, inside the rear piece 31 is a spring set 32, an end of the rear piece 31 is set an adjusting set 33, both the spring set 32 and the adjusting set 33 are connected each other, then the spring set 32 being controlled; a gas-control portion 7 is installed on a bottom of a butt 14 of the body 1, and the gas-control portion 7 has a combining body 71, a rotating piece 72 is behind and connects to the combining body 71; inside the combining body 71 has a thimble 73 and an adjusting rod 74, and the thimble 73 is able to contain the adjusting rod 74, an end of the adjusting rod 74 penetrates through the combining body 71 to connect to the rotating piece 72, the adjusting rod 74 is driven by the rotating piece 72 as well.

Figure 2A:
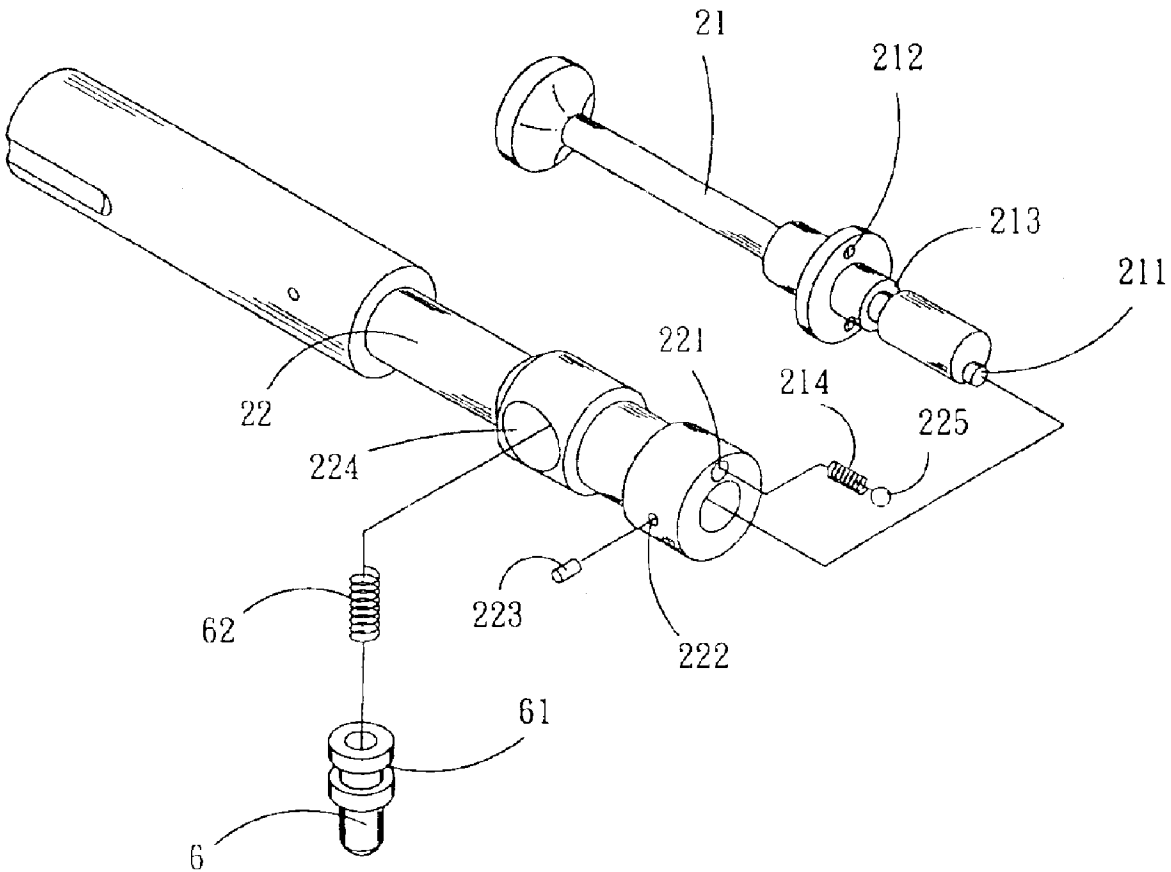
FIG. 2A is an explored view of an extruder of the present invention.
Figure 2B:
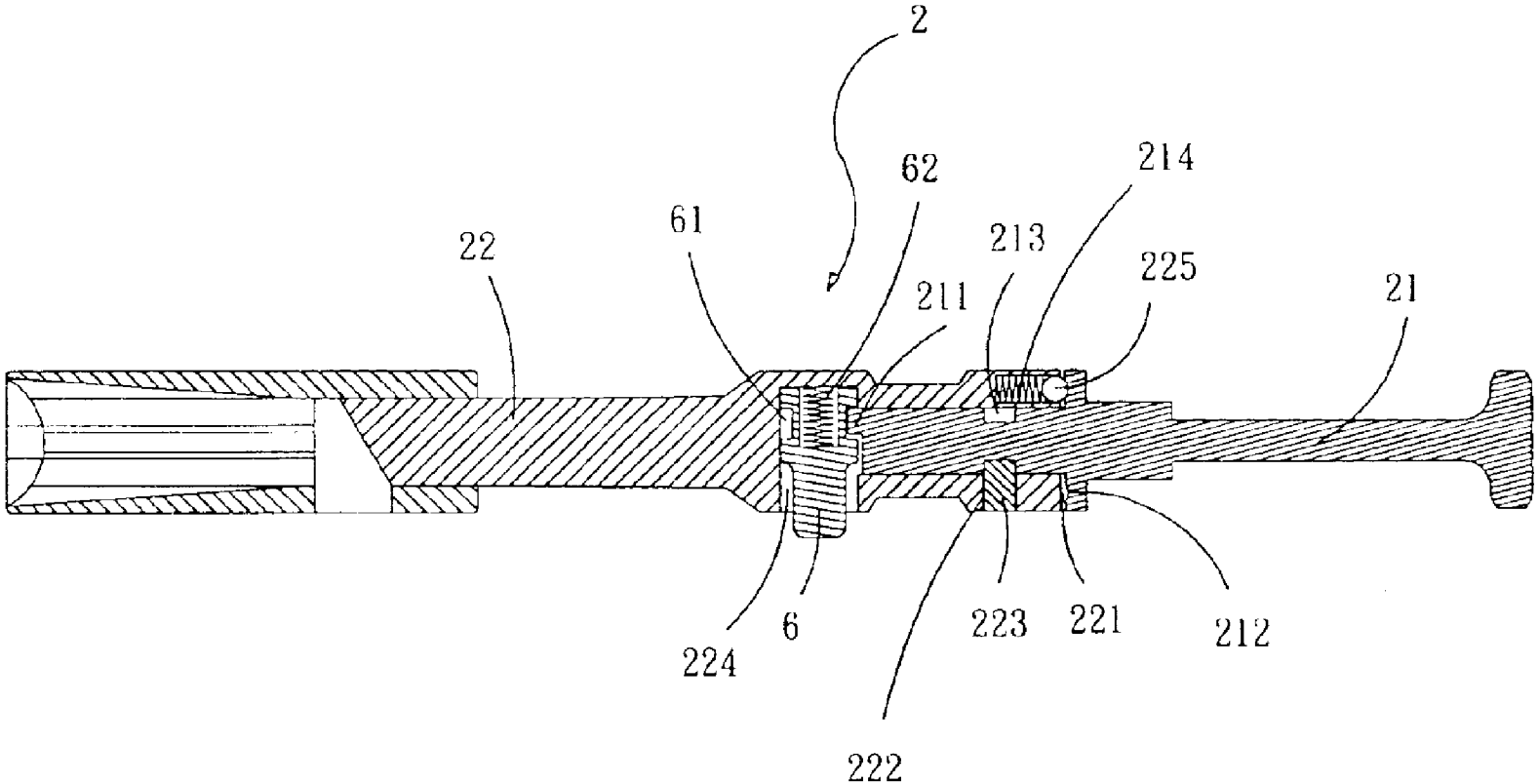
FIG. 2B is a sectional view of an assembly of the extruder of the present invention.

Please refer to FIG. 2A to FIG. 4B. As shown in FIG. 2A, which is an explored view of an extruder of the present invention. An eccentric position of a radius plane of an end of the pulling portion 21 of the extruder 2 is formed as a projecting rod 211; an end of the connecting piece 6 approaching to a central axis of the injecting portion 22 is designed a ring trough 61, that is, the ring trough 61 located a place where is opposite to the projecting rod 211. Referring to FIG. 2B, which is a sectional view of an assembly of the extruder of the present invention. The projecting rod 211 is against to the ring trough 61 to let a connection of the pulling portion 21 and the connecting piece 6 be made. Two adjacent radial planes between the pulling portion 21 and the injecting portion 22 respectively set two positioning apertures 212 and another positioning aperture 221, wherein the two positioning apertures 212 are symmetrically set on the radial plane of the pulling portion 21 for 180° rotational positioning of the pulling portion 21. Further, each positioning aperture 212 has a positioning ball 225 therein; the positioning ball 225 is against to a spring 214 for that the positioning ball 225 is fixed in the positioning aperture 212. As it can be seen, the two positioning balls 225, the two springs 214 and the three positioning apertures 212 and 221 are required components for rotating and positioning the pulling portion 21.

A neck portion 213 with a smaller diameter is on the pulling portion 21 around two adjacent axial planes between the pulling portion 21 and the injecting portion 22. A third aperture 222 containing a third positioning piece 223 is on the injecting portion 22 corresponding to the neck portion 213, the third positioning piece 223 is against to the neck portion 213. A containing aperture 224 is radically set on the injecting portion 22 and contains the connecting piece 6. The connecting piece 6 is against to a bottom of the containing aperture 224 by means of a flexible piece 62.

Figure 3A:
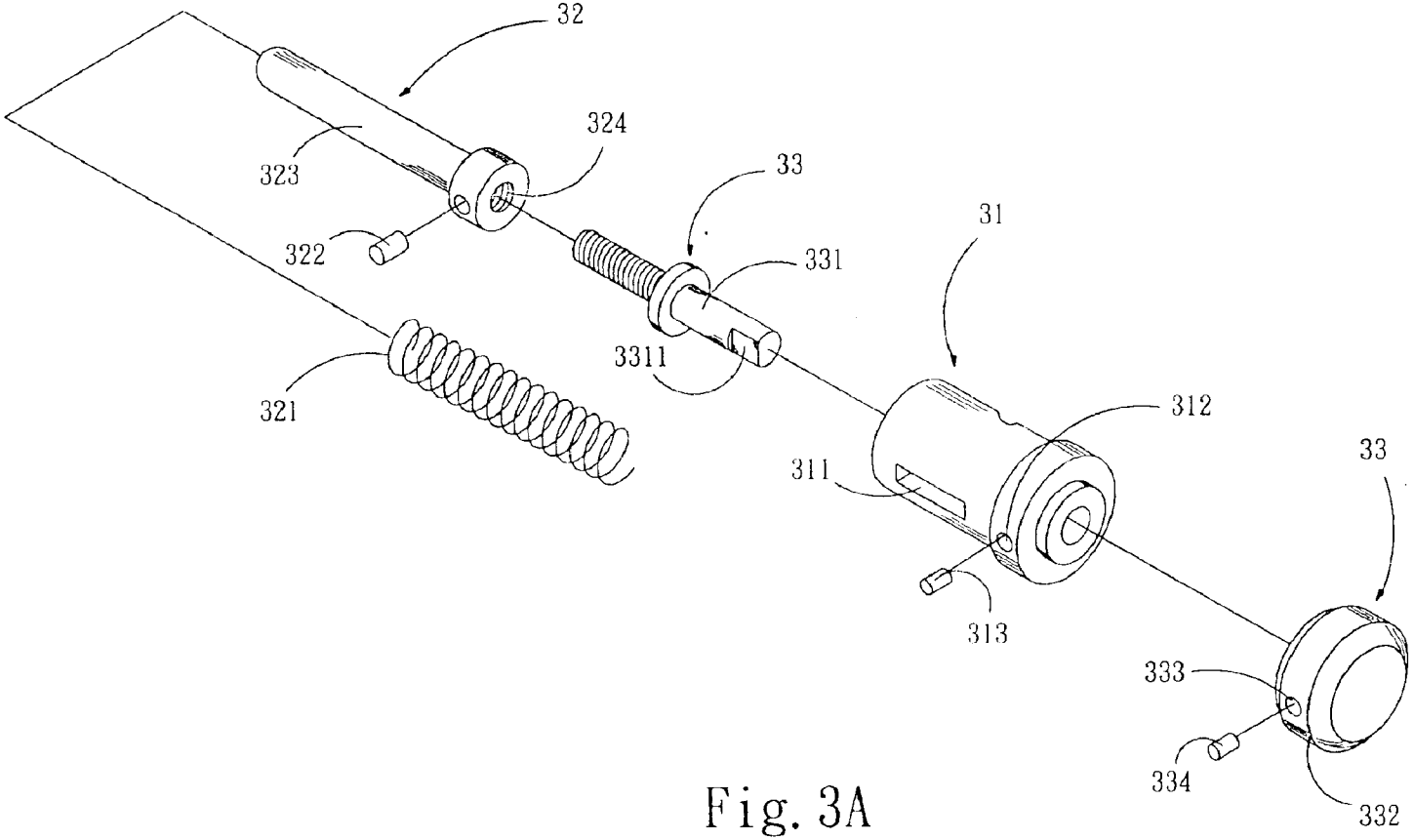
FIG. 3A is an explored view of a rear portion of the present invention.

Please refer to FIG. 3A, which is an explored view of a rear portion of the present invention. The spring set 32 consists of a spring 321 and a leading rod 323 with a projecting block 322. The rear piece 31 has a leading trough 311, which contains the projecting block 322 sliding therein. The adjusting set 33 includes an adjusting rod 331 connecting to the leading rod 323 and a knob 332 controlling the adjusting rod 331. An axis of the leading rod 323 axially has a joining trough 324, which matching with the adjusting rod 331. More, internal the joining trough 324 is an inner screw and external the adjusting rod 331 is an outer screw, both screws are fit each other to let the adjusting rod 331 be turned in and out of the leading rod 323.

Figure 3B:
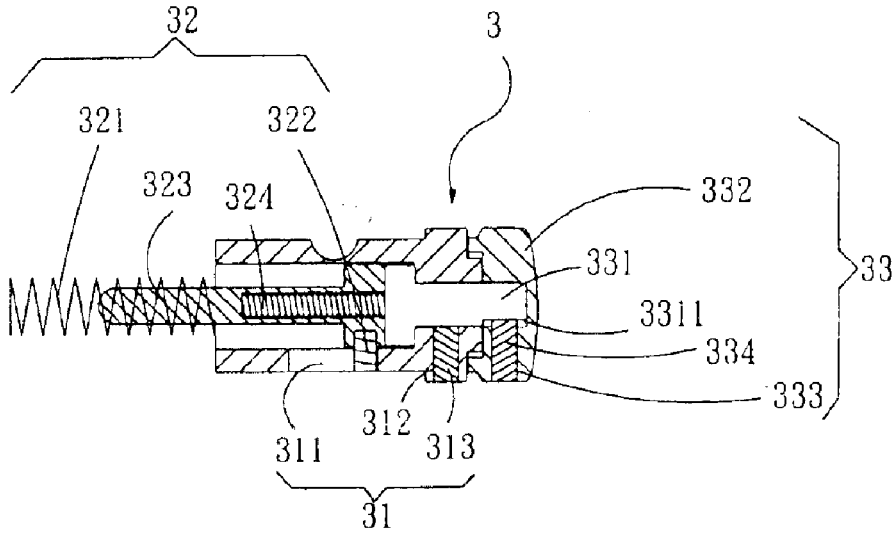
FIG. 3B is a sectional view of an assembly of the rear portion of the present invention.

Please refer to FIG. 3B, which is a sectional view of an assembly of the rear portion of the present invention. A side around an end of the rear piece 31 is drilled a first aperture 312. The first aperture 312 has a first positioning piece 313 therein, the first positioning piece 313 contacts onto a middle portion of the adjusting rod 331 to position the adjusting rod 331 in the rear piece 31. A side of the knob 332 is opened having a second aperture 333. A second positioning piece 334 is contained in the second aperture 333. An axial plane 3311 is formed on a side of an end of the adjusting rod 331 to cooperate with the first positioning piece 313 for fixing and limiting rotation.

Figure 4B:
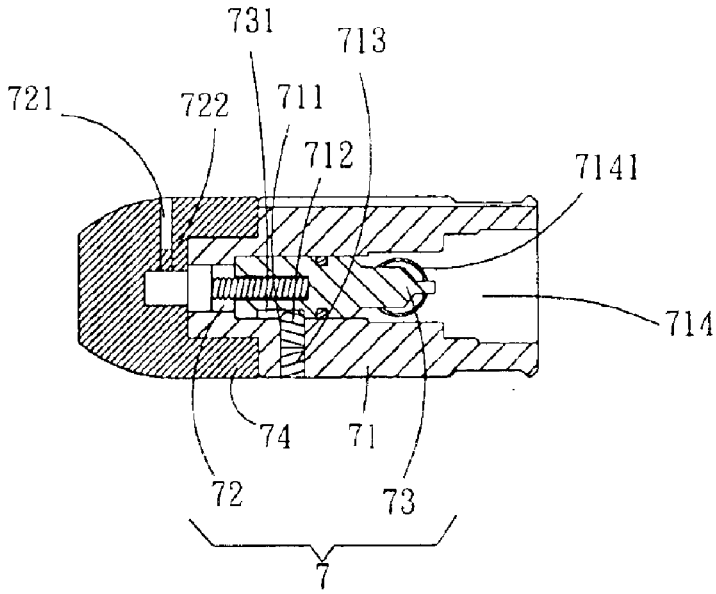
FIG. 4B is a sectional view of an assembly of the gas-control portion of the present invention.
Figure 4A:
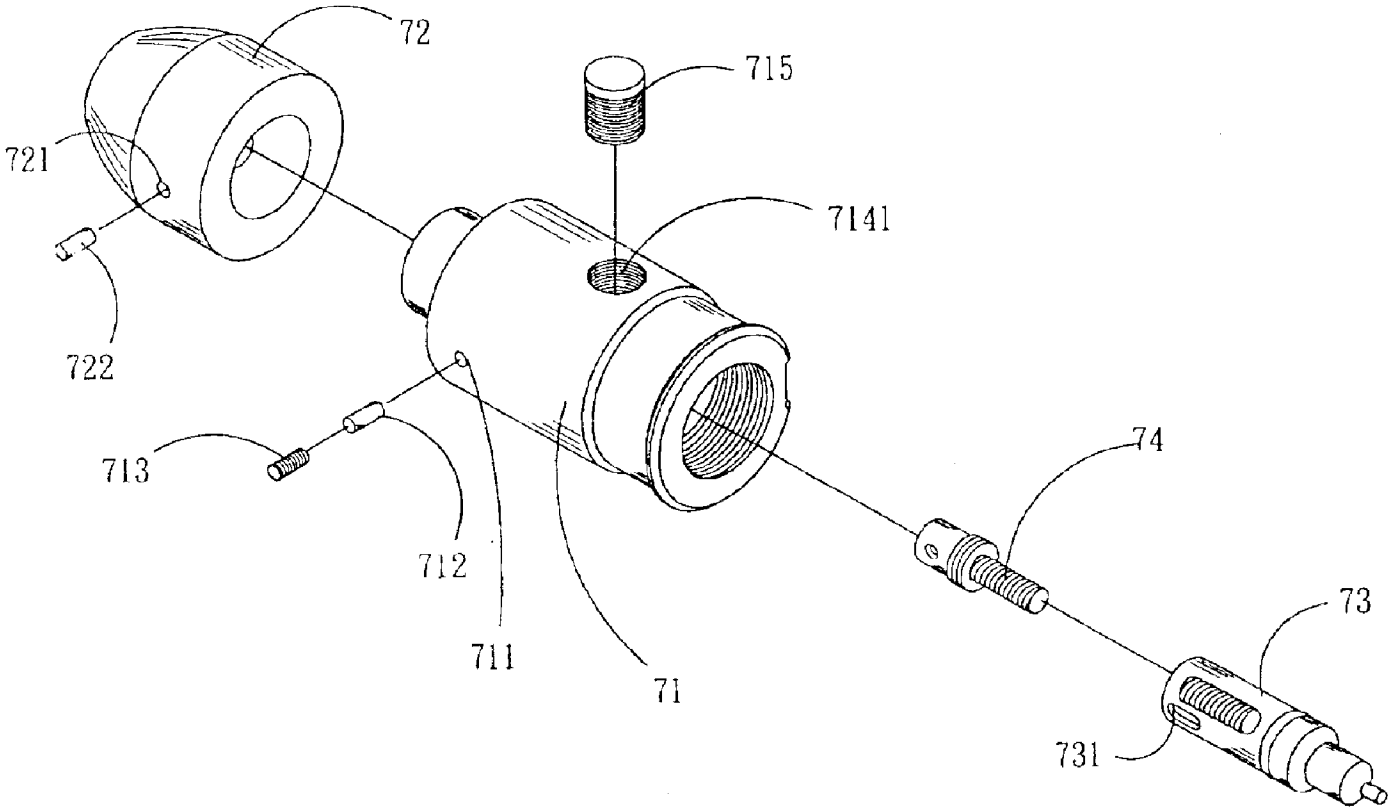
FIG. 4A is an explored view of a gas-control portion of the present invention.

Please refer to FIG. 4A, which is an explored view of a gas-control portion of the present invention. The rotating piece 72 has a fifth aperture 721, whose inside being set a fifth positioning piece 722 for fixing the adjusting rod 74 and the rotating piece 74. Inside the thimble 73 is designed an internal screw and outside the adjusting rod is designed an external screw, both screws are matched each other. A slot 731 is set on a side of an end of the thimble 73 around the adjusting rod 74. A fourth aperture 711 is opened on the combining body 71 and located corresponding to the slot 731. Inside the fourth aperture 711 is design a fourth positioning piece 712, which connecting to the slot 731. Behind the fourth positioning piece 712 has a fixing piece 713 for fixing the fourth positioning piece 712 on a predetermined location of the fourth aperture 711. Please refer to FIG. 4B, which is a sectional view of an assembly of the gas-control portion of the present invention. A penetrating trough 714 is axially installed on the combining body 71 and intersected with the thimble 73. A rotch 7141 located on an end of the penetrating trough 714 has internally a plugging piece 715 (shown as in FIG. 4A), which functions sealing the rotch 7141.

Figure 5:
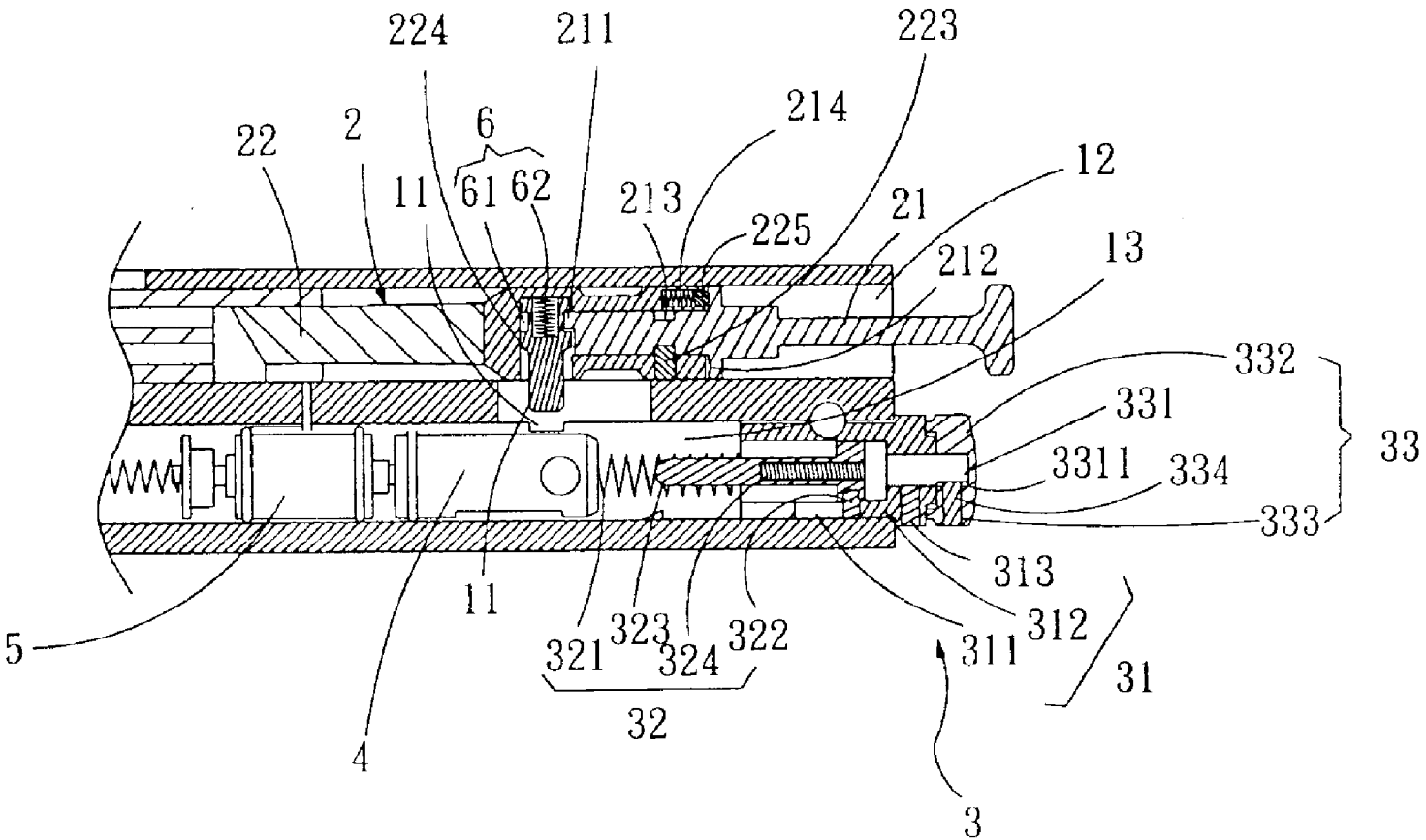
FIG. 5 is a detail sectional view of relative positions of the extruder and a mechanical component of the present invention.

Generally, the prior art to exclude the condition of a bullet stuck in a barrel is to dismantle both a mechanical component and an extruder firstly. On the other hand, the present invention may not do so. Please refer to FIG. 5, which is a detail sectional view of relative positions of the extruder and a mechanical component of the present invention. For the design of the extruder 2, the connecting piece 6 is driven by the pulling portion 21, thus to rotate the pulling portion 21 is to generate relative and radial motions among the connecting piece 6 in the connecting trough 11, the injection portion 22 and the mechanical component 4; further that, the connecting piece 6 is taken off from the mechanical component 4 to terminate the connecting stage of the extruder 2 and the mechanical component 4, and thus the extruder 2 is out from the upper moving trough 12 for cleaning inside of the gun.

While rotating the pulling portion 21 of the extruder 2, the projecting rod 211 of a front end of the pulling portion 21 presses the ring trough 61 of the connecting piece 6. The projecting rod 211 is located on a eccentric position of a radial plane of the pulling portion 21, and it lets that the projecting rod 211 moves a distance equal to the diameter of the pulling portion 21, and the connecting piece 6 moves the same distance as well; therefore, the extruder 2 and the mechanical component 4 are driven simultaneously. Besides, the two positioning apertures 212, the positioning aperture 221 and the positioning balls 225 are the base requirements to positioning the pulling portion 21 after rotating the pulling portion 21. The connecting piece 6 is against to the bottom of the containing aperture 224 by means of the flexible piece 62 for the connecting stage of the extruder 2 and the mechanical component 4 being more stable.

Figure 6:
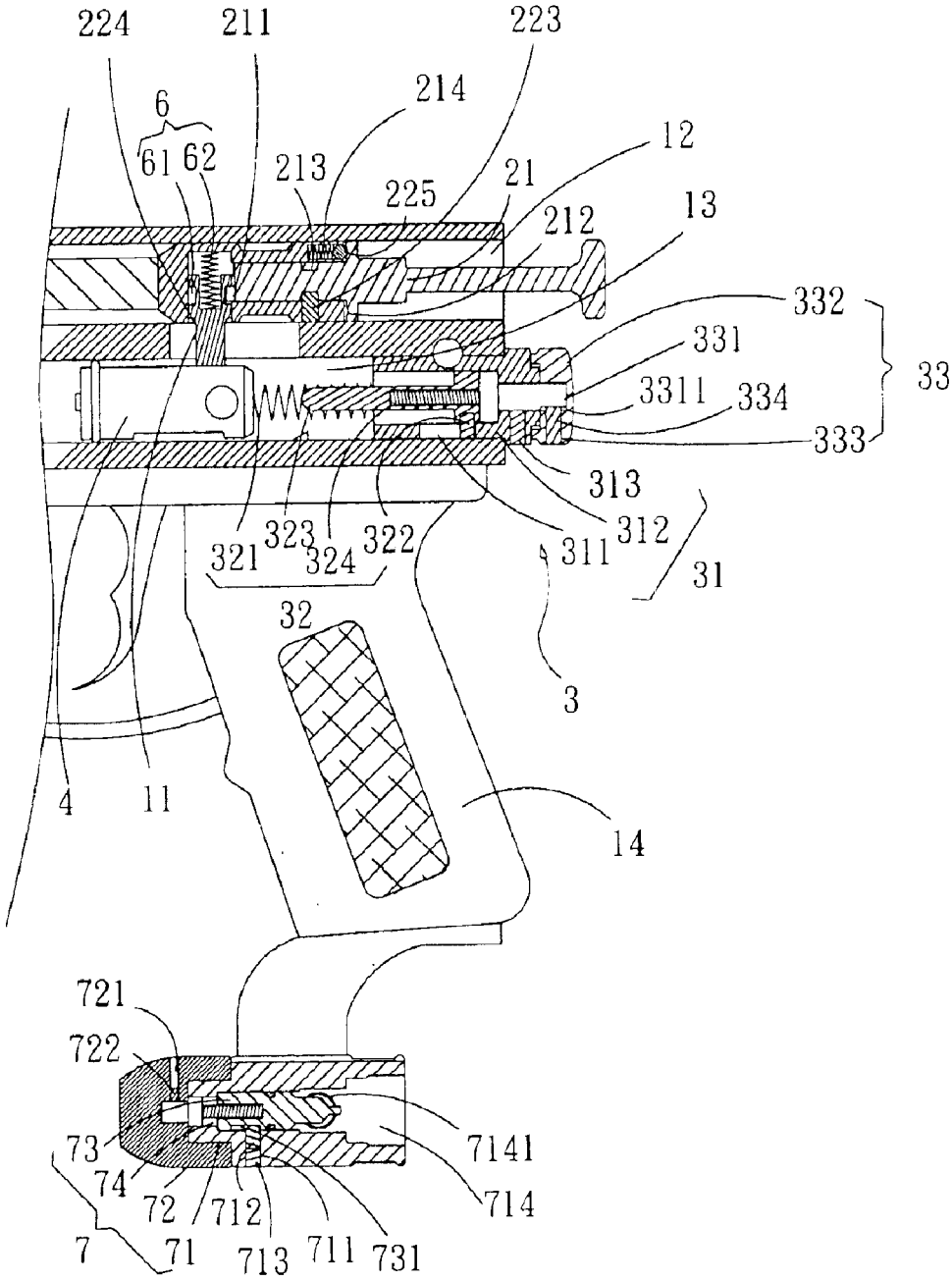
FIG. 6 is a detail sectional view of the rear portion of the present invention.

Please refer to FIG. 6, which is a detail sectional view of the rear portion of the present invention. For the design of the rear portion 3 and the gas-control portion 7, it is to hope that while controlling the adjusting rod 331 by means of rotating the knob 332 is to move the leading rod 323 in the rear piece 31 back and forth, and the knob 332 is not moved axially even though it is rotated radically. To rotate the rotating piece 72 to controlling the adjusting rod 74 is to drive the thimble 73 for further controlling the thimble 73. However, although the rotating piece 72 is revolved, it is not moved axially.

While the knob 332 being turned, the adjusting rod 331 is simultaneously revolved because of the first positioning piece 313 connecting to the axial plane 3311 of the end of the adjusting rod 331. The leading rod 323 is driven by the adjusting rod 331 because both are screwed each other. While the adjusting rod 331 being turned, the leading rod 323 is then moved back and forth in the rear piece 31 by means of the projecting block 322 and the leading trough 311. Therefore, the spring set 32 is controlled in the rear piece 31 and the knob 332 has no axial movement.

Figure 7:
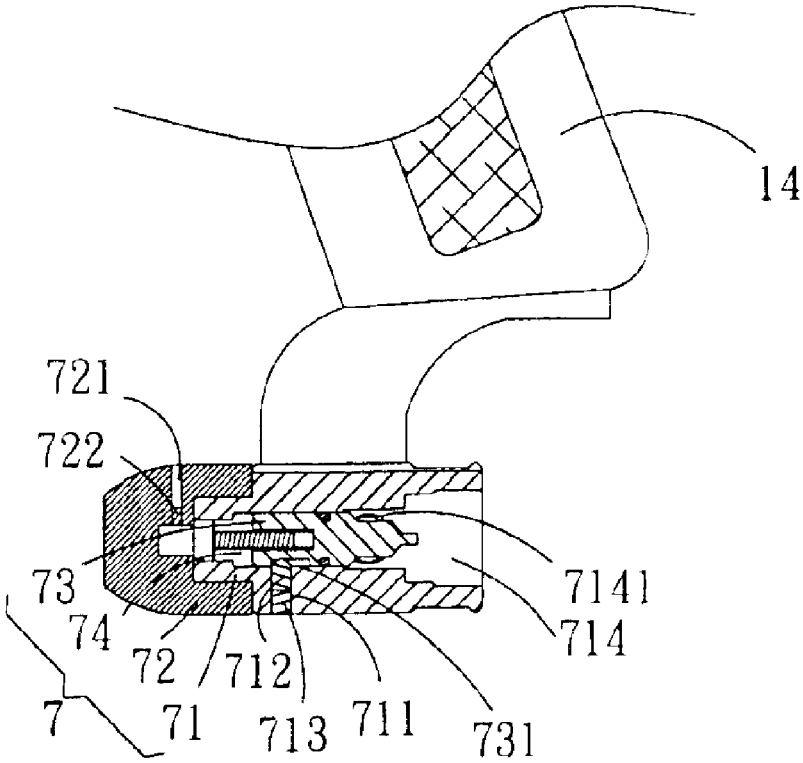
FIG. 7 is a detail sectional view of the gas-control portion of the present invention.

Please refer to FIG. 7, which is a detail sectional view of the gas-control portion of the present invention. To utilize the rotating piece 72 to regulate the adjusting rod 74, then the thimble 73 is screw with the adjusting rod 74 for connection. Continuously, while revolving the rotating piece 72 and keeping the adjusting rod 74 in a position, the thimble 73 is capable of moving axially in the combining body 71 via the slot 731 and the fourth positioning piece 712, further to control a gas tank (not shown in the Fig.) connecting to the gas-control portion 7.

In case of necessarily disassembling the gas tank, to withdraw the thimble 73 from its working position to close the gas tank for preventing the left gas blowing out.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. An improved structure for a toy gun comprising:

a body having an upper trough and a lower trough disposed in parallel relationship with the upper trough, the body having a connecting trough in open communication with the upper and lower troughs for providing a connection therebetween;

an extruder displaceably disposed inside the upper trough and having a pulling portion extending proximally from the upper trough, the extruder having an injecting portion coupled to the pulling portion for axial displacement therewith, the pulling portion being rotatable with respect to the injecting portion;

a rear portion disposed inside the lower trough;

a mechanical component disposed in the lower trough and connected to the rear portion;

a valve controller disposed in the lower trough and connected to the mechanical component in series; and, a connecting piece disposed in the connecting trough and coupled to the pulling portion of the extruder for reversible displacement within the connecting trough to selectively connect to and disconnect from the mechanical component responsive to rotation of the pulling portion of the extruder.

2. The improved structure for a toy gun as cited in claim 1, wherein the pulling portion of the extruder has a projecting rod extending from a location spaced from a central axis of the pulling portion, the connecting piece having a ring trough formed therein adjacent one end thereof, the projecting rod being received in the ring trough to provide coupling therebetween.

3. The improved structure for a toy gun as cited in claim 1, wherein the injecting portion has at least one first positioning aperture formed in a proximal end thereof, a positioning spring and a positioning ball being disposed sequentially within the first positioning aperture, the pulling portion having two second positioning apertures formed therein and selectively alignable with the first positioning aperture.

4. The improved structure for a toy gun as cited in claim 1, wherein the injecting portion has an axially extending bore formed in a proximal end thereof, the pulling portion having a neck portion with a reduced diameter adjacent a distal end thereof, the distal end and the neck portion of the pulling portion being disposed in the axially extending bore of the injecting portion, the injecting portion having an aperture formed therein adjacent the proximal end thereof, the neck portion of the pulling portion being aligned with the aperture, a positioning piece being disposed in the aperture and engaging the neck portion to rotatably couple the pulling portion to the injecting portion.

5. The improved structure for a toy gun as cited in claim 1, wherein the injecting portion has a containing aperture formed radially therein, the connecting piece being at least partially disposed in the containing aperture, the connecting piece being biased outwardly from the containing aperture by a flexible piece disposed between the connecting piece and a bottom wall of the containing aperture.

* * * * *